US008365375B2

(12) United States Patent
Lin

(10) Patent No.: US 8,365,375 B2
(45) Date of Patent: Feb. 5, 2013

(54) RIVET GUN WITH DETACHABLE PNEUMATIC CYLINDER ASSEMBLY

(76) Inventor: Yu-Ching Lin, Xizhi (TW)

( * ) Notice: Subject to any disclaimer, the term of this patent is extended or adjusted under 35 U.S.C. 154(b) by 312 days.

(21) Appl. No.: 12/905,146

(22) Filed: Oct. 15, 2010

(65) Prior Publication Data

US 2012/0090142 A1 Apr. 19, 2012

(51) Int. Cl.
*B21J 15/22* (2006.01)

(52) U.S. Cl. ..... 29/243.525; 29/243.523; 72/391.4

(58) Field of Classification Search ..... 29/243.523, 29/243.524, 243.525; 72/391.4, 391.6
See application file for complete search history.

(56) References Cited

U.S. PATENT DOCUMENTS 4,515,005 A * 5/1985 Klein ..... 29/243.525
5,742,989 A * 4/1998 Subotsch ..... 29/243.525
6,978,526 B1 * 12/2005 Lin ..... 29/243.525

* cited by examiner

*Primary Examiner* — David B Jones
(74) *Attorney, Agent, or Firm* — Bacon & Thomas, PLLC

(57) ABSTRACT

A rivet gun has a barrel, a shaft, a handle and a pneumatic cylinder assembly. The shaft is mounted under the barrel. The handle is mounted around the shaft. The pneumatic cylinder assembly is mounted under the handle and has a top cover, a fastener, an annular cylinder and a bottom base. The top cover, fastener, annular cylinder and bottom base are detachably assembled so can be replaced easily without changing the whole pneumatic cylinder assembly. The maintenance costs of the rivet gun are reduced.

8 Claims, 5 Drawing Sheets

RIVET GUN WITH DETACHABLE PNEUMATIC CYLINDER ASSEMBLY

BACKGROUND OF THE INVENTION

1. Field of the Invention

The present invention relates to a rivet gun, and more particularly to a rivet gun that has a detachable pneumatic cylinder assembly so that components inside the pneumatic cylinder assembly may be replaced easily without changing the whole pneumatic cylinder assembly. The maintenance costs of the rivet gun are reduced.

2. Description of Related Art

Taiwan utility model patents No. M286081 and M272598 disclose conventional rivet guns for mounting rivets on at least two pieces so that the rivets securely hold the pieces together. A rivet has a cap and a core pin. The cap is T-shaped and has an enlarged end and a mounting end. The core pin is mounted longitudinally through, protrudes out of the cap and has two ends and a ball formed on one end and adjacent to the mounting end of the cap.

A conventional rivet gun comprises a barrel, a handle, a trigger, a pin collector and a pneumatic cylinder.

The barrel has a front end, a rear end and a vise assembly that may vise and pull a core pin of a rivet on the front end into the barrel. The handle is mounted perpendicularly on the barrel and has air passageways. The collector is a jar mounted on the rear end of the barrel to collect the ejected core pins. The pneumatic cylinder is mounted movably under the handle and capable of activating the vise assembly through pneumatic and hydraulic means. Furthermore, the pneumatic cylinder may be connected to a high-pressure air source such as an air bottle to implement the ejection of the core pin.

When the rivet gun is used to rivet two pieces such as boards or plates together, a rivet is mounted through the pieces. The enlarged end of the cap of the rivet abuts an inside piece and the front end of the barrel of the rivet gun abuts the enlarged end. The trigger is pulled to activate the vise assembly to pull a core pin on the cap into the barrel. The ball on the core pin longitudinally compresses and radially expands the mounting end of the cap into T-shape so that the expanded mounting end hooks on an outside piece to complete the riveting process. Then, the air output by the high-pressure air source flows through the barrel from the front end to the rear end and sucks the broken core pin vised by the vise assembly backward into the collector A casing of the pneumatic cylinder is formed integrally and manufactured by insert-molding processes to ensure good airtight/watertight properties thereof. However, disassembling the integrally formed casing is not easy, which raises the difficulty of repairing or replacing components inside the pneumatic cylinder. Therefore, the whole pneumatic cylinder is frequently replaced even though only few inside components are damaged. Maintaining the rivet gun is expensive.

To overcome the shortcomings, the present invention provides a rivet gun with detachable pneumatic cylinder assembly to mitigate or obviate the aforementioned problems.

SUMMARY OF THE INVENTION

The main objective of the invention is to provide a rivet gun that has a detachable pneumatic cylinder assembly so that components inside the pneumatic cylinder assembly may be replaced easily without changing the whole pneumatic cylinder assembly. The maintenance costs of the rivet gun are reduced.

A rivet gun in accordance with the present invention comprises a barrel, a shaft, a handle and a pneumatic cylinder assembly. The shaft is mounted under the barrel. The handle is mounted around the shaft. The pneumatic cylinder assembly is mounted under the handle and has a top cover, a fastener, an annular cylinder and a bottom base. The top cover, fastener, annular cylinder and bottom base are detachably assembled so can be replaced easily without changing the whole pneumatic cylinder assembly. The maintenance costs of the rivet gun are reduced.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
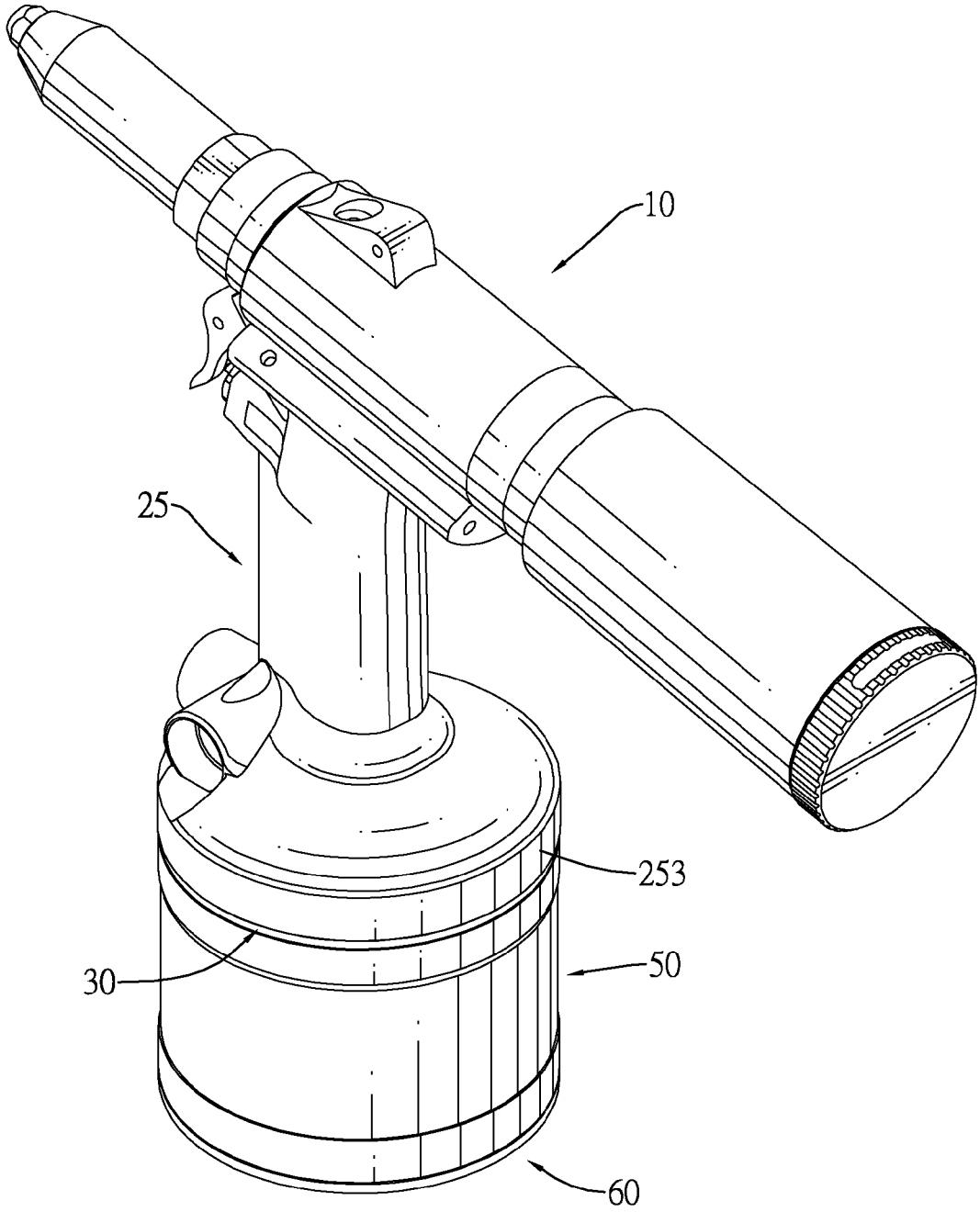
FIG. 1 is a perspective view of a rivet gun with detachable pneumatic cylinder assembly in accordance with the present invention.
Figure 2:
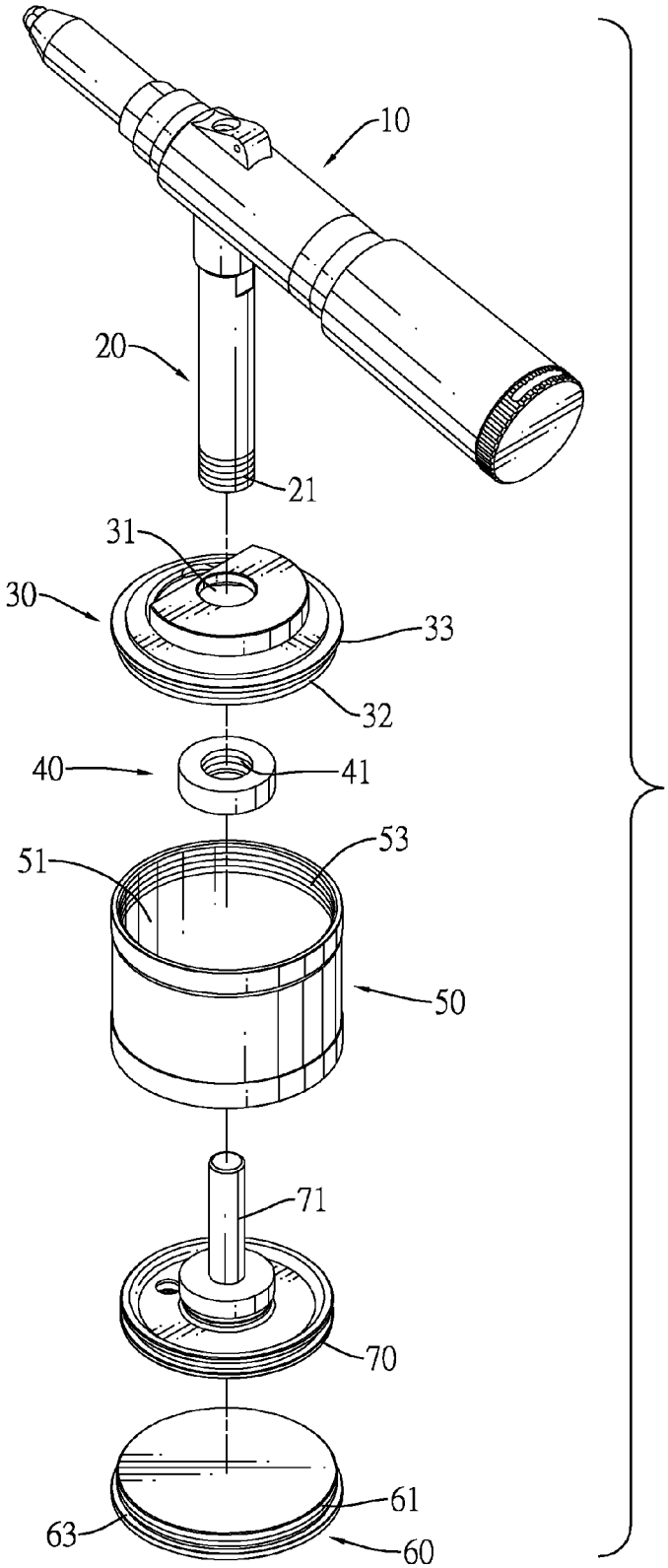
FIG. 2 is an exploded perspective view of the rivet gun in FIG. 1.
Figure 3:
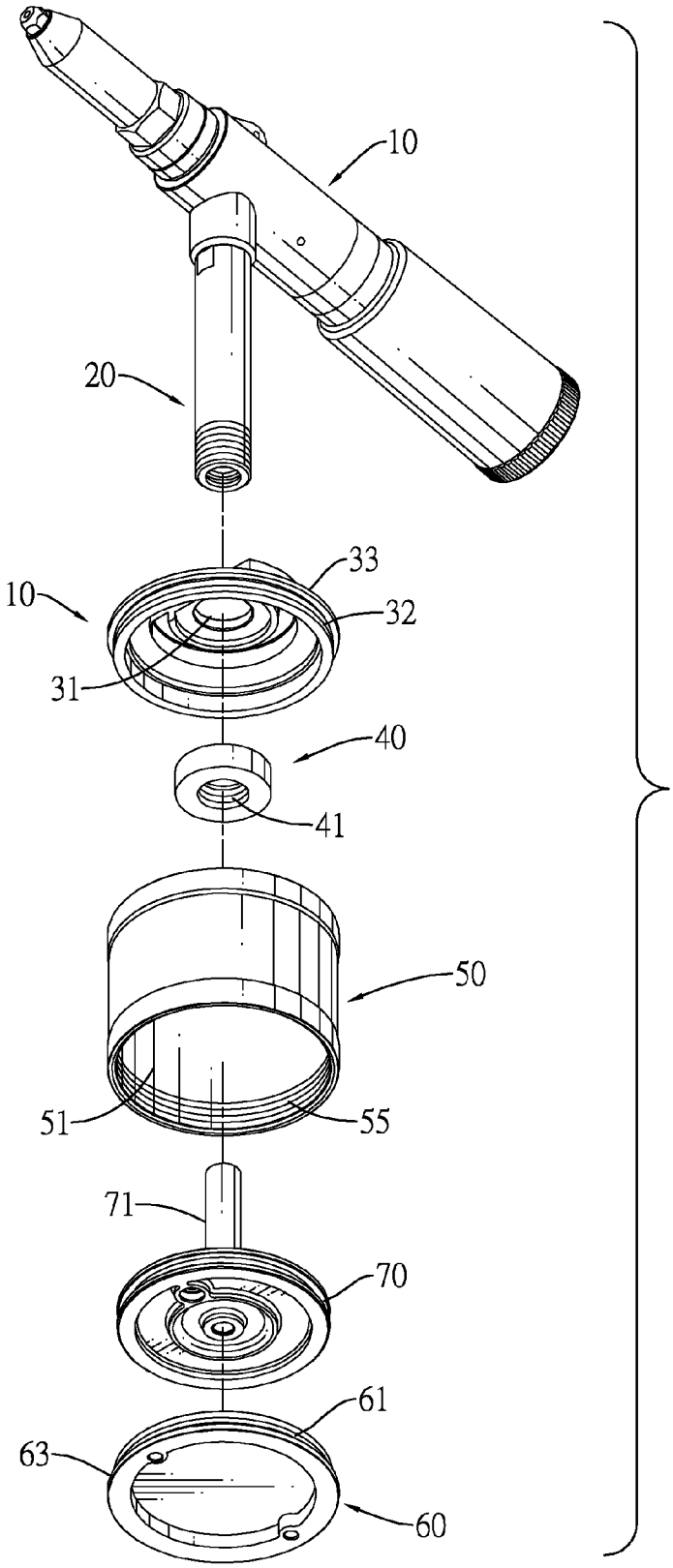
FIG. 3 is another exploded perspective view of the rivet gun in FIG. 2.

With reference to FIGS. 1 to 3, a rivet gun in accordance with the present invention comprises a barrel (10), a shaft (20), a handle (25) and a pneumatic cylinder assembly and may further have a piston assembly.

The barrel (10) is hollow and has a front end, a rear end, a bottom, a rivet driving assembly and a pin collector. The rivet driving assembly is mounted in the barrel (10). The pin collector is mounted detachably on the rear end.

Figure 4:
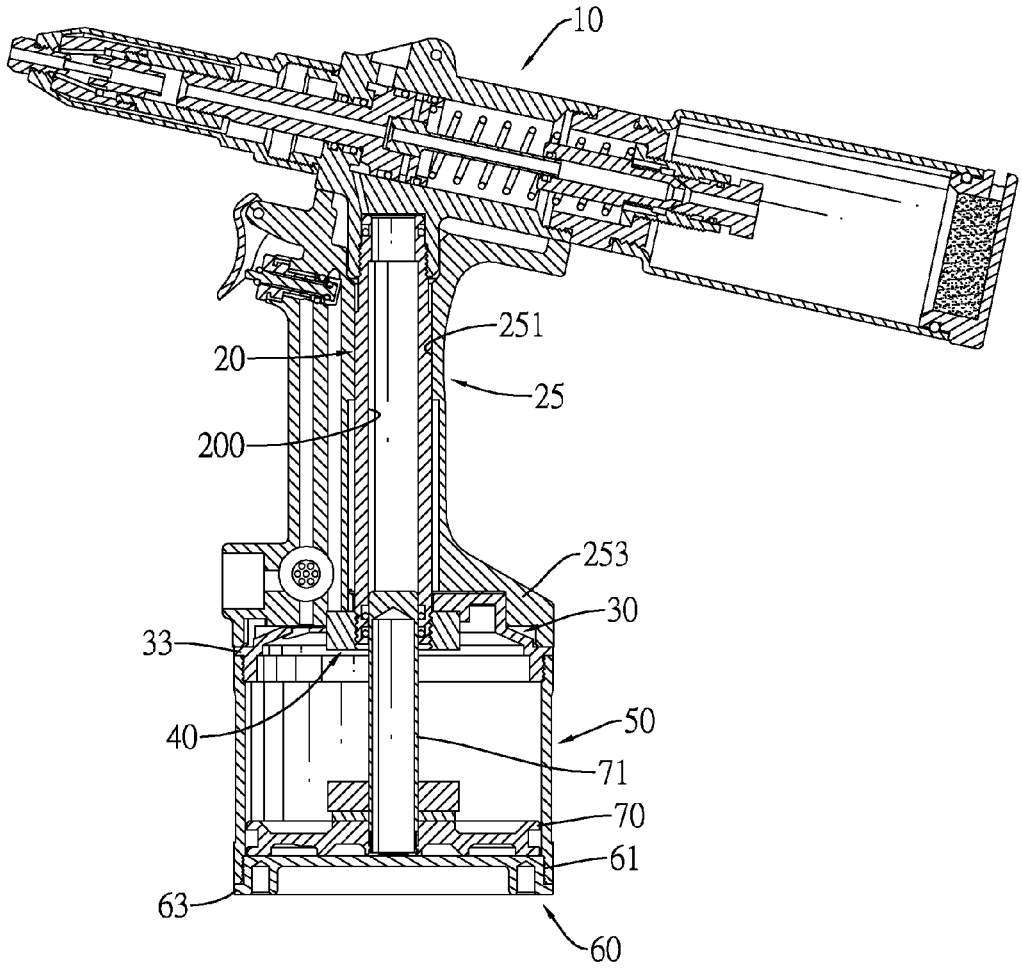
FIG. 4 is a cross sectional side view of the rivet gun in FIG. 1.
Figure 5:
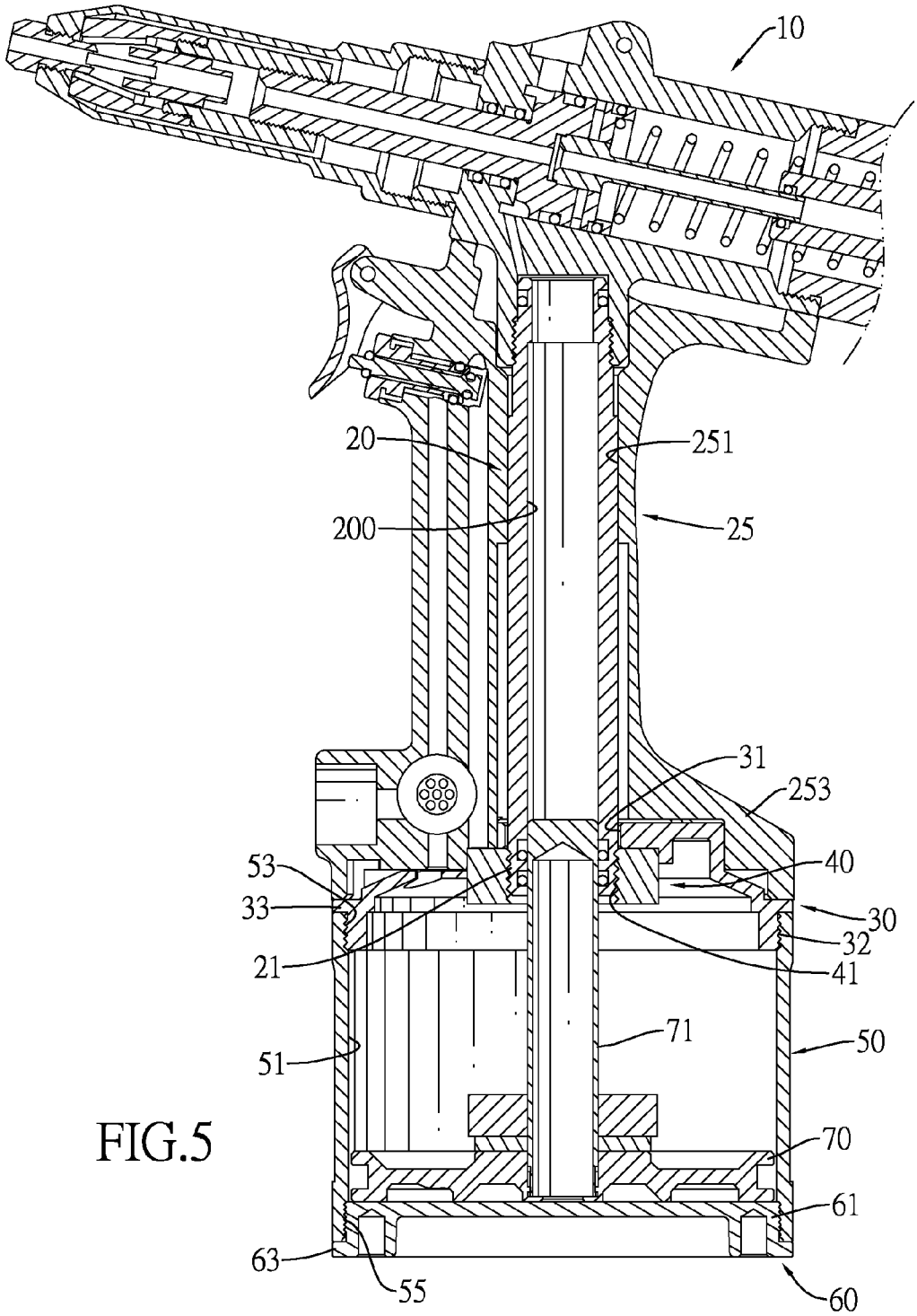
FIG. 5 is an enlarged cross section side view of the rivet gun in FIG. 4.

With further reference to FIGS. 4 and 5, the shaft (20) is mounted under the bottom of the barrel (10) and has a top end, a bottom end, a central hole (200) and an outer thread (21). The central hole (200) is defined longitudinally through the shaft (20). The outer thread (21) is formed around the bottom end of the shaft (20).

The handle (25) is mounted around the shaft (20) and has a top end, a bottom end, a mounting hole (251) and an annular shoulder (253). The mounting hole (251) is defined through the handle (25) and mounted around the shaft (20). The annular shoulder (253) is formed on and protrudes radially outward from the bottom end of the handle (25).

The pneumatic cylinder assembly is mounted under the bottom end of the handle (25) and has a top cover (30), a fastener (40), an annular cylinder (50) and a bottom base (60).

The top cover (30) is mounted detachably on the bottom end of the shaft (20), abuts the annular shoulder (253) of the handle (25) and has an outer edge, a through hole (31), an upper thread (32) and an annular flange (33). The through hole (31) is defined through the top cover (30) and mounted around the shaft (20). The upper thread (32) is formed on the outer edge. The annular flange (33) is formed on and protrudes radially outward from the outer edge.

The fastener (40) is mounted detachably on the bottom end of the shaft (20) and abuts the top cover (30) so that the top cover (30) is mounted and limited between the fastener (40) and the annular shoulder (253) of the handle (25). The fastener (40) may be a nut having a threaded hole (41) defined through the nut and corresponding to and engaging with the outer thread (21) of the shaft (20).

The annular cylinder (50) is mounted detachably under the top cover (30) and has a top end, a bottom end, a cavity (51), a top thread (53) and a bottom thread (55).

The top end of the annular cylinder (30) abuts the annular flange (33) of the top cover (30).

The cavity (51) is defined thorough the annular cylinder (50).

The top thread (53) is formed on the top end of the annular cylinder (50) and corresponds to and engaging with the upper thread (32).

The bottom thread (55) is formed on the bottom end of the annular cylinder (50).

The bottom base (60) is mounted detachably on the bottom end of the annular cylinder (50) and has an outer edge, a lower thread (61) and an annular tab (63). The lower thread (61) is formed on the outer edge of the bottom base (60) and corresponds to and engages with the bottom thread (55) of the annular cylinder (50). The annular tab (63) is formed on and protrudes radially outward from the outer edge of the bottom base (60) and abuts the bottom end of the annular cylinder (50).

The piston assembly is mounted in the cavity (51) of the annular cylinder (50) and has a head (70) and a rod (71).

The head (70) is mounted slidably in the cavity (51) of the annular cylinder (50).

The rod (71) is mounted on the head (70) and extends slidably in the central hole (200) of the shaft (20).

The components such as the top cover (30), fastener (40), annular cylinder (50) and bottom base (60) are detachably assembled to form the pneumatic cylinder assembly. Therefore, the aforementioned components are replaced easily without changing the whole pneumatic cylinder assembly. The maintenance costs of the rivet gun are reduced.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A rivet gun comprising:

a barrel being hollow and having a front end, a rear end and a bottom;

a shaft mounted under the bottom of the barrel and having a top end, a bottom end and a central hole defined through the bottom end;

a handle mounted around the shaft and having a top end and a bottom end; and a pneumatic cylinder assembly mounted under the bottom end of the handle and having a top cover mounted detachably on the bottom end of the shaft and having an outer edge, a through hole defined through the top cover and mounted around the shaft;

a fastener mounted detachably on the bottom end of the shaft and abutting the top cover so that the top cover is mounted and limited between the fastener and the annular shoulder of the handle;

an annular cylinder mounted detachably under the top cover and having a top end, a bottom end, a cavity defined through the annular cylinder; and a bottom base mounted detachably on the bottom end of the annular cylinder.

2. The rivet gun as claimed in claim 1, wherein the handle further has an annular shoulder formed on and protruding radially outward from the bottom end of the handle; and the top cover abuts the annular shoulder.

3. The rivet gun as claimed in claim 2, wherein the shaft further has an outer thread formed around the bottom end of the shaft; and the fastener is a nut and has a threaded hole defined through the nut and corresponding to and engaging with the outer thread of the shaft.

4. The rivet gun as claimed in claim 3, wherein the top cover further has an upper thread formed on the outer edge; and the annular cylinder further has a top thread formed on the top end of the annular cylinder and corresponding to and engaging with the upper thread.

5. The rivet gun as claimed in claim 4, wherein the annular cylinder further has a bottom thread formed on the bottom end of the annular cylinder; and the bottom base further has a lower thread formed on the outer edge of the bottom base and corresponding to and engaging with the bottom thread.

6. The rivet gun as claimed in claim 5, wherein the top cover further has an annular flange formed on and protruding radially outward from the outer edge; and the top end of the annular cylinder abuts the annular flange of the top cover.

7. The rivet gun as claimed in claim 6, wherein the bottom base further has an annular tab formed on and protruding radially outward from the outer edge of the bottom base and abutting the bottom end of the annular cylinder.

8. The rivet gun as claimed in claim 7 further comprising a piston assembly having a head mounted slidably in the cavity of the annular cylinder; and a rod mounted on the head and extending slidably in the central hole of the shaft.

* * * * *